US009583894B2

(12) United States Patent
Shirakawa et al.

(10) Patent No.: US 9,583,894 B2
(45) Date of Patent: Feb. 28, 2017

(54) CABLE SIGNAL DETECTOR AND CONNECTORIZED COMMUNICATION CABLE

(71) Applicant: Hitachi Metals, Ltd., Tokyo (JP)

(72) Inventors: Yohei Shirakawa, Hitachi (JP); Koki Hirano, Hitachinaka (JP); Takumi Kobayashi, Hitachi (JP); Yoshitake Ageishi, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/732,686

(22) Filed: Jun. 6, 2015

(65) Prior Publication Data

US 2015/0371523 A1 Dec. 24, 2015

(30) Foreign Application Priority Data

Jun. 20, 2014 (JP) ..... 2014-127224

(51) Int. Cl.

| | |
|---|---|
| ***G08B 25/08*** | (2006.01) |
| ***H01R 13/66*** | (2006.01) |
| *H01R 24/64* | (2011.01) |

(52) U.S. Cl.

CPC ..... *H01R 13/6691* (2013.01); *H01R 13/6683* (2013.01); *H01R 24/64* (2013.01)

(58) Field of Classification Search

CPC ..... H01R 13/6683; H01R 13/0091; H01R 31/065; H01R 13/6691; H01R 13/66; H01R 13/665; H01R 13/6675; H01R 24/64; H01R 31/00; H01R 31/005; H01R 31/02; H01R 31/06; H04W 4/005; H04W 4/006; H04W 4/008; G08B 21/18; G08B 21/182; G08B 21/195; G08B 25/08; G08B 25/085; G08B 25/10; G08B 5/36; H04Q 2209/47

See application file for complete search history.

(56) References Cited

U.S. PATENT DOCUMENTS

| | | | | |
|---|---|---|---|---|
| 8,011,794 | B1 * | 9/2011 | Sivertsen | H05B 33/0803 362/231 |
| 2002/0010518 | A1 * | 1/2002 | Reid | G06Q 10/087 700/31 |
| 2008/0204034 | A1 * | 8/2008 | Blades | G01R 31/041 324/522 |

FOREIGN PATENT DOCUMENTS

| | | | |
|---|---|---|---|
| JP | 5274671 | B2 | 8/2013 |
| WO | WO 2010/078080 | A | 7/2010 |

* cited by examiner

*Primary Examiner* — Van Trieu

(74) *Attorney, Agent, or Firm* — McGinn IP Law Group, PLLC

(57) ABSTRACT

A cable signal detector includes a detection unit that is provided in a connector attached to an end of a communication cable or in a relay connector to be connected to the connector, and branches, extracts and sends a portion of signal transmitted through the cable, and a visualization unit that is provided separately from the connector or the relay connector and includes a light-emitting circuit to emit a light when receiving the signal sent from the detection unit.

19 Claims, 8 Drawing Sheets

CABLE SIGNAL DETECTOR AND CONNECTORIZED COMMUNICATION CABLE

The present application is based on Japanese patent application No. 2014-127224 filed on Jun. 20, 2014, the entire contents of which are incorporated herein by reference.

BACKGROUND OF THE INVENTION

1. Field of the Invention

The invention relates to a cable signal detector and a connectorized communication cable using the cable signal detector.

2. Description of the Related Art

In data centers etc., the connection of communication cables such as LAN (local area network) cables may be changed in accordance with layout change, displacement or addition of information communication device such as a server or hub.

Some information communication devices are provided with a connection check lamp for checking the connection of communication cable.

An information communication device has also proposed in which the connection of a communication cable is monitored by detecting the insertion and removal of the connector of the communication cable (see, e.g., JP-B-5274671).

SUMMARY OF THE INVENTION

The conventional devices can only check the physical connection of the communication cable and has a problem that it is not possible to check whether the communication is actually established through the communication cable. Thus, it is not possible to check for the establishment of communication.

Therefore, the communication cable may be erroneously pulled out without noticing the establishment of communication. Thus, a failure such as a shutdown of the information communication device or corruption of data during transfer may be caused.

In the case that the connection of the communication cable is monitored as done in JP-B-5274671, the communication cable needs a built-in monitoring signal line. Thus, a problem may arise that it is not possible to use universal communication cables and the manufacturing cost increases.

It is an object of the invention to provide a cable signal detector that prevents a communication cable from being erroneously pulled out by indicating the state of information communication therethrough and can be applied to universal communication cables, as well as a connectorized communication cable using the cable signal detector.

(1) According to one embodiment of the invention, a cable signal detector comprises:

a detection unit that is provided in a connector attached to an end of a communication cable or in a relay connector to be connected to the connector, and branches, extracts and sends a portion of signal transmitted through the cable; and a visualization unit that is provided separately from the connector or the relay connector and comprises a light-emitting circuit to emit a light when receiving the signal sent from the detection unit.

(2) According to another embodiment of the invention, a connectorized communication cable comprises:

a communication cable;

a connector integrally formed at an end of the communication cable;

a detection unit provided in the connector to branch, extract and send a portion of signal transmitted through the cable; and a visualization unit that is provided separately from the connector and comprises a light-emitting circuit emitting light when receiving the signal sent from the detection unit.

In the above embodiment (1) or (2) of the invention, the following modifications and changes can be made.

(i) The detection unit comprises a detection unit-side electrode electrically connected to a signal line of the communication cable, wherein the visualization unit comprises a visualization unit-side electrode connected to the detection unit-side electrode, and wherein the visualization unit-side electrode is connected to the detection unit-side electrode such that the signal transmitted through the communication cable is received by the visualization unit.

(ii) At least one of the detection unit and the visualization unit comprises a rectifier circuit for adjusting the level of the signal extracted from the communication cable.

(iii) The detection unit comprises a short-range communication transmitter electrically connected to a signal line of the communication cable, and wherein the visualization unit comprises a short-range communication receiver for receiving the signal sent from the transmitter.

(iv) The detection unit comprises a rectifier circuit and an amplifier circuit between the signal line of the communication cable and the transmitter such that the signal amplified by the amplifier circuit is sent from the transmitter, wherein the rectifier circuit adjusts the level of the signal extracted from the cable and wherein the amplifier circuit amplifies the signal from the rectifier circuit and outputs the amplified signal to the transmitter.

(v) The detection unit comprises a power supply receiver to receive a wireless power supply signal to supply power to the amplifier circuit, and wherein the visualization unit comprises a power supply transmitter to send the wireless power supply signal to the power supply receiver.

EFFECTS OF THE INVENTION

According to one embodiment of the invention, a cable signal detector can be provided that prevents a communication cable from being erroneously pulled out by indicating the state of information communication therethrough and can be applied to universal communication cables, as well as a connectorized communication cable using the cable signal detector.

BRIEF DESCRIPTION OF THE DRAWINGS

Next, the present invention will be explained in more detail in conjunction with appended drawings, wherein:

FIGS. 1A and 1B are diagrams illustrating a cable signal detector in an embodiment of the present invention, wherein FIG. 1A shows the entire configuration including a transmitter, a receiver and a communication cable and FIG. 1B shows a schematic configuration of a detection unit and a visualization unit;

FIGS. 10A and 10B are diagrams illustrating a cable signal detector in another embodiment of the invention, wherein FIG. 10A shows the entire configuration including a transmitter, a receiver and a communication cable and FIG. 10B shows a schematic configuration thereof;

DETAILED DESCRIPTION OF THE PREFERRED EMBODIMENTS

Embodiments of the invention will be described below in conjunction with the appended drawings.

Figure 1A:
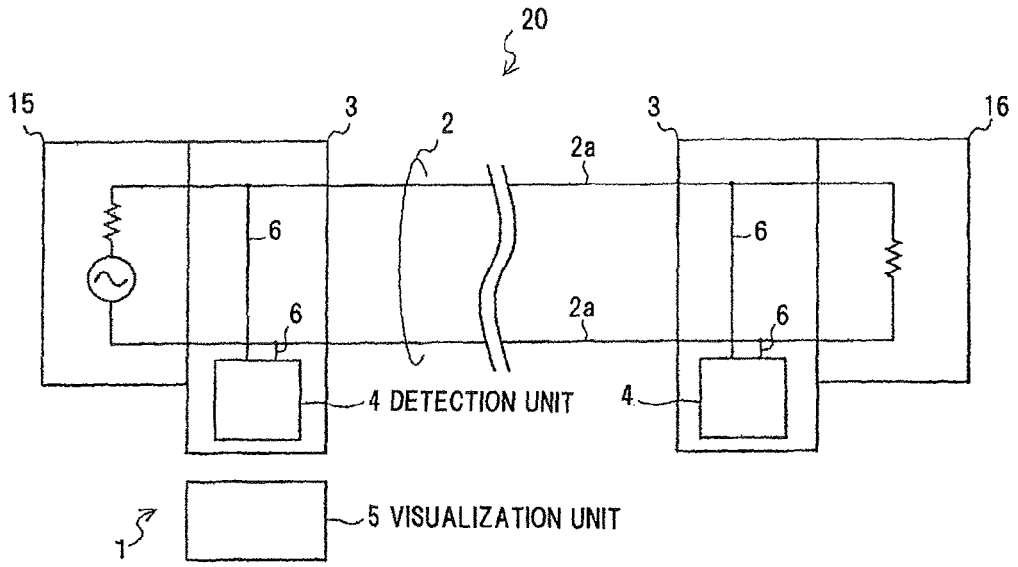
Figure 1B:
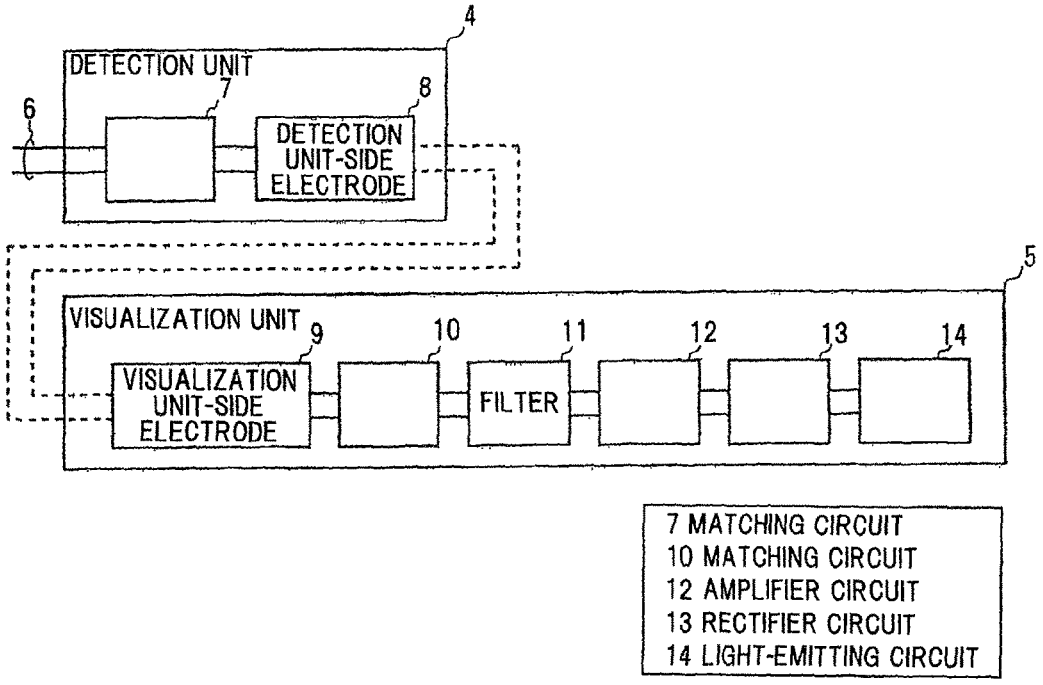

FIGS. 1A and 1B are diagrams illustrating a cable signal detector in the present embodiment, wherein FIG. 1A shows the entire configuration including a transmitter, a receiver and a communication cable and FIG. 1B shows a schematic configuration of a detection unit and a visualization unit.

As shown in FIG. 1A and 1B, a cable signal detector 1 is composed of a detection unit 4 provided in a connector 3 attached to an end of a communication cable 2 and a visualization unit 5 provided separately from the connector 3.

As the communication cable 2, it is possible to use a general LAN cable. The communication cable 2 having four pairs of signal lines 2*a* (eight signal lines in total) is used in the present embodiment. FIG. 1A shows only one of the four pairs of signal lines 2*a*.

Figure 2A:
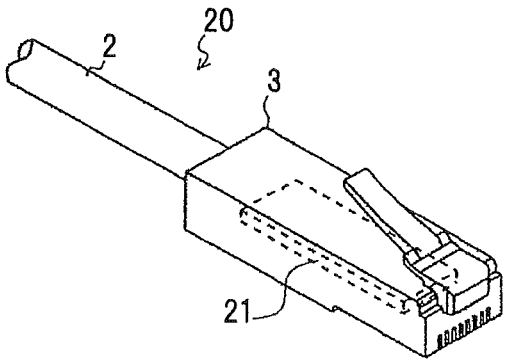
FIG. 2A is a perspective view showing a connector.

As shown in FIG. 2A, the connectors 3 comprise RJ45 plugs provided at both ends of the communication cable 2. One of the connectors 3 of the communication cable 2 is connected to a transmitter 15 and another connector 3 is connected to a receiver 16. A connectorized communication cable 20 in the present embodiment is formed by integrally providing the connectors 3 at both ends of the communication cable 2.

The detection unit 4 is configured to branch, extract and send a portion of signal transmitted through the cable, and is mounted on the connector 3. The detection unit 4 is provided with a detection unit-side electrode 8 electrically connected to the signal lines 2*a* of the communication cable 2 via branch transmission paths 6.

A matching circuit 7 is provided on the branch transmission paths 6 to provide impedance matching in a predetermined frequency band. The matching circuit 7 also serves to adjust the level of a signal to be extracted from the communication cable 2 and is configured to be a high-impedance circuit so that deterioration of signals to be transmitted is suppressed. The matching circuit 7 is mounted on a substrate 21 (see FIG. 2A) provided inside the connectors 3.

Figure 3A:
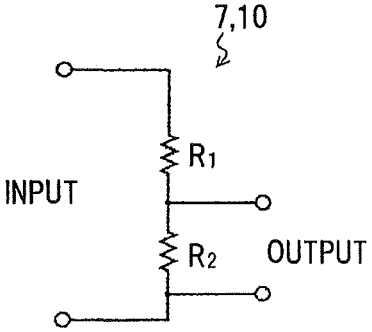
FIGS. 3A and 3B are circuit diagrams illustrating examples of a rectifier circuit used in the cable signal detector of FIGS. 1A and 1B.
Figure 3B:
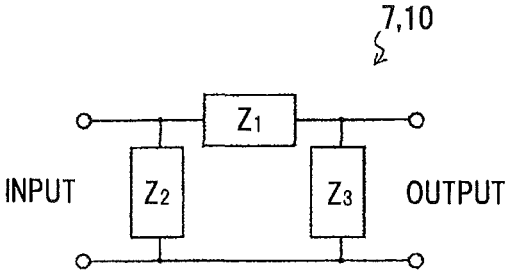

In the present embodiment, a matching circuit 10 is provided in the visualization unit 5 and the matching circuit 7 in the detection unit 4 thus can be omitted. As the matching circuits 7 and 10, it is possible to use, e.g., a resistive voltage-divider circuit as shown in FIG. 3A or a $\pi$-type matching circuit as shown in FIG. 3B.

The visualization unit 5 is provided separately from the connector 3 mounting the detection unit 4 and has a light-emitting circuit 14 which emits light when receiving the signals sent by the detection unit 4. In the present embodiment, the visualization unit 5 is provided with a visualization unit-side electrode 9 which is connected to the detection unit-side electrode 8.

In the cable signal detector 1, the visualization unit-side electrode 9 is connected to the detection unit-side electrode 8, so the signal transmitted through the communication cable 2 is received by (input to) the visualization unit 5 via the two electrodes 8 and 9. In other words, the cable signal detector 1 is configured that signal transmission from the detection unit 4 to the visualization unit-side electrode 9 is wire communication.

Figure 2B:
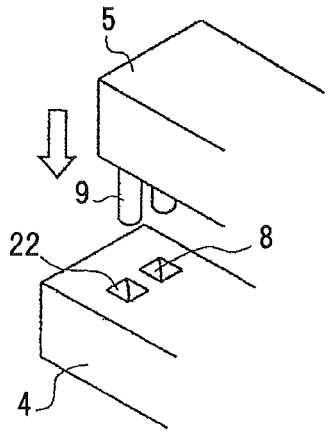
FIG. 2B is a perspective view showing an example of connection between the detection unit and the visualization unit.

For example, as shown in FIG. 2B, the visualization unit-side electrodes 9 of the visualization unit 5 may have a pin-shape and inserted into connection holes 22 formed on the connector 3, so that the detection unit-side electrodes 8 provided inside the connection holes 22 are brought into contact with and electrically connected to the visualization unit-side electrodes 9. Alternatively, a connector may be provided to connect the two electrodes 8 and 9.

The visualization unit 5 is composed of the visualization unit-side electrode 9, the matching circuit 10, a filter 11, an amplifier circuit 12, a rectifier circuit 13 and the light-emitting circuit 14 which are connected sequentially.

The matching circuit 10 is to provide impedance matching in a predetermined frequency band. In case that the matching circuit 7 is not provided in the detection unit 4, the matching circuit 10 also serves to adjust the level of a signal to be extracted from the communication cable 2.

A band-pass filter which only passes frequencies within a predetermined range is used as the filter 11. The filter 11 serves to remove noise prior to amplification by the amplifier circuit 12.

Figure 4:
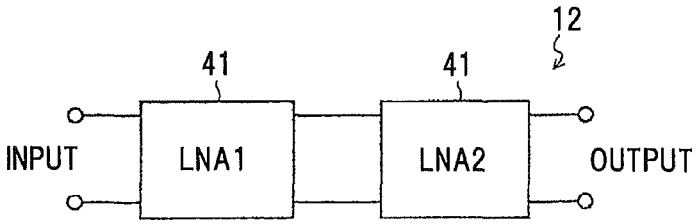
FIG. 4 is a circuit diagram illustrating an example of an amplifier circuit used in the cable signal detector of FIGS. 1A and 1B.
Figure 5A:
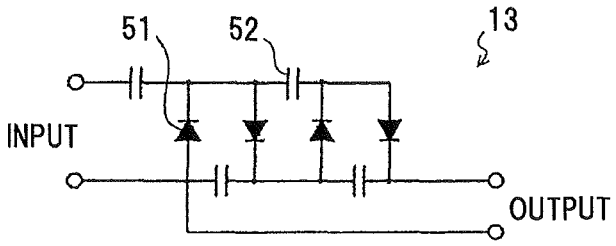
FIGS. 5A to 5D are circuit diagrams illustrating examples of a rectifier circuit used in the cable signal detector of FIGS. 1A and 1B.
Figure 5B:
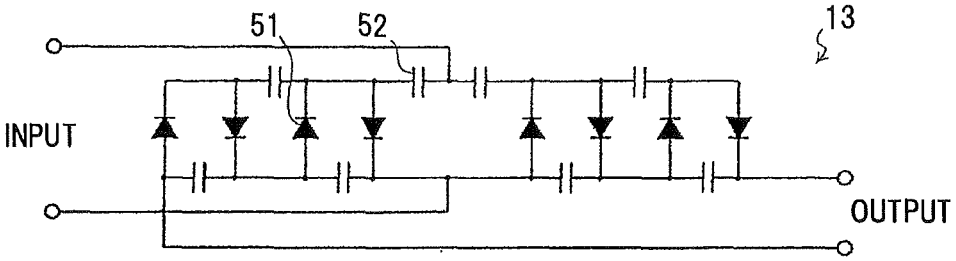
Figure 5C:
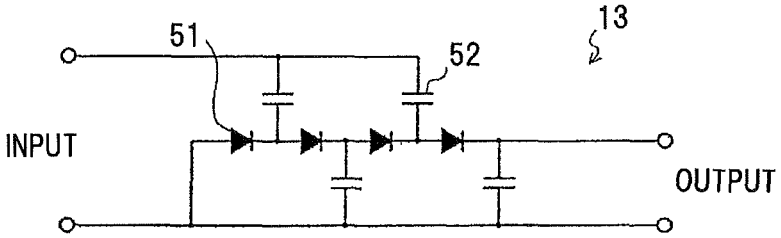
Figure 5D:
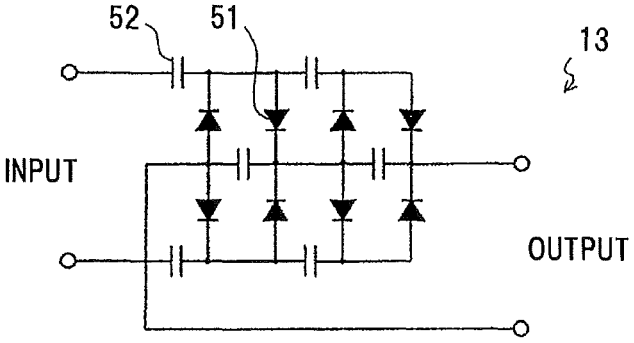

It is preferable to use a LNA (Low Noise Amplifier) for the amplifier circuit 12. In the present embodiment, since the level of signal prior to amplification is small due to using a high-impedance circuit as the matching circuit 7, amplification can be provided by connecting LNAs 41 in multi-stages (in this example, two stages) as shown in FIG. 4.

A power supply is required to operate the amplifier circuit 12. Thus, a battery is built-in the visualization unit 5 or power is supplied to the visualization unit 5 from the outside.

The rectifier circuit 13 is to rectify AC signals amplified by the amplifier circuit 12 into DC signals and can be a well-known full-wave rectifier circuit or half-wave rectifier circuit. Specifically, circuits formed by combining diodes 51 with capacitive elements 52 as shown in FIGS. 5A to 5D are used as the rectifier circuit 13.

Figure 6A:
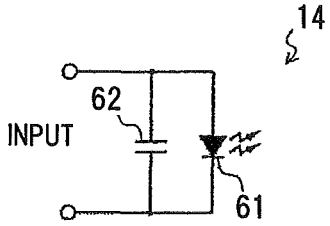
FIGS. 6A to 6C are circuit diagrams illustrating examples of a light-emitting circuit used in the cable signal detector of FIGS. 1A and 1B.
Figure 6B:
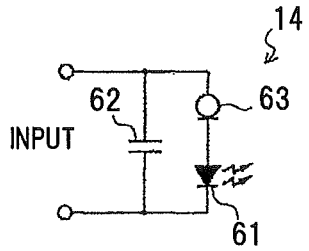
Figure 6C:
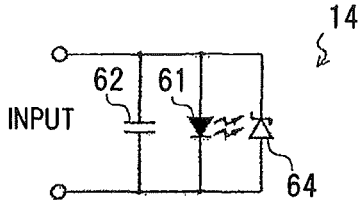

The light-emitting circuit 14 is formed by, e.g., connecting an LED (light-emitting diode) 61 in parallel to a capacitive element 62 for cutting off high frequency, as shown in FIG. 6A. Alternatively, to adjust a current flowing through the LED 61 into a desired current value, a constant-current diode 63 (or a DC-DC converter) may be connected in series to the LED 61 as shown in FIG. 6B or a Zener diode 64 may be connected in parallel to the LED 61 as shown in FIG. 6C.

When using the cable signal detector 1 in the present embodiment to check the communication state, the visualization unit-side electrode 9 of the visualization unit 5 is connected to the detection unit-side electrode 8 of the detection unit 4. Then, a portion of signal, if present and transmitted through the signal lines 2*a* of the communication cable 2, is branched and output to the visualization unit 5 through the branch transmission path 6, the matching circuit 7 and the detection unit-side electrode 8, is amplified by the amplifier circuit 12 after passing through the visualization unit-side electrode 9, the matching circuit 10 and the filter 11, is rectified into DC by the rectifier circuit 13 and is then input to the light-emitting circuit 14 in which the LED 61 thereby emits light. Workers can judge the communication state by checking whether or not the LED 61 is emitting light.

Although each of the two connectors 3 provided at both ends of the communication cable 2 mounts the detection unit 4 in the present embodiment, the detection unit 4 may be provided on only one of the connectors 3. However, when the both connectors 3 mount the detection units 4, it is possible to check the communication state by two connectors 3 and it is thus more effective to prevent removal of the cable by mistake.

In addition, although signal transmission from the detection unit 4 to the visualization unit-side electrode 9 is wire communication in the present embodiment, it is not limited thereto. It is possible to configure to wirelessly send signals from the detection unit 4 to the visualization unit-side electrode 9.

Figure 7:
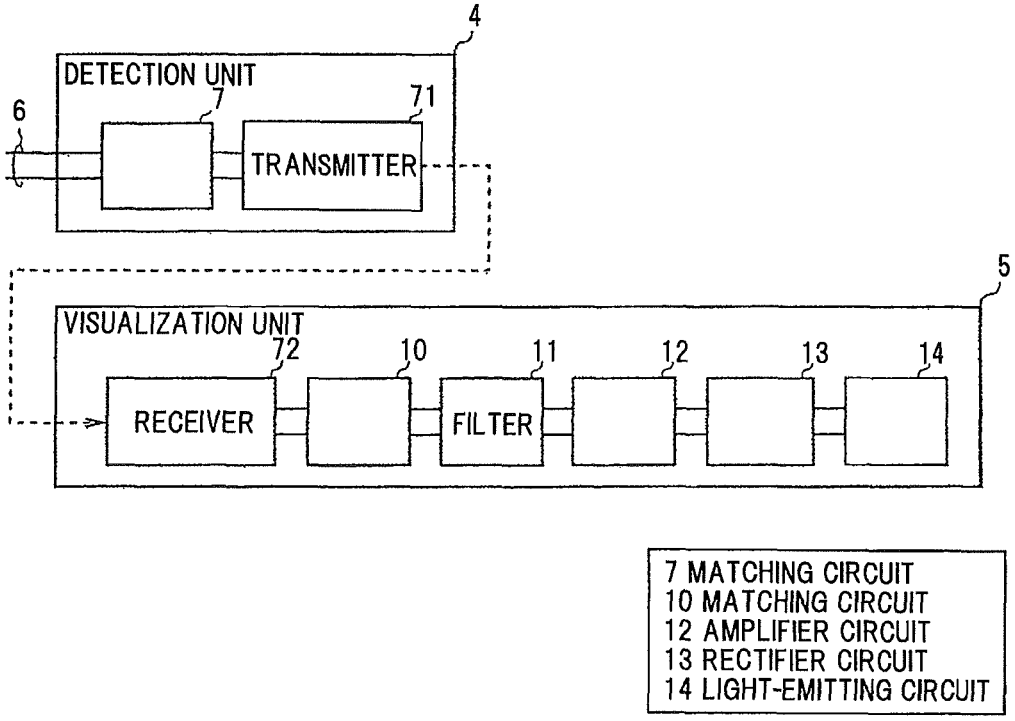
FIG. 7 is a diagrams illustrating a schematic configuration of a cable signal detector in a modification of the invention.

In such a case, a short-range communication transmitter 71 such as antenna or coupler is provided on the detection unit 4 and a short-range communication receiver 72 such as antenna or coupler is provided on the visualization unit 5 to receive signals sent by the transmitter 71, as shown in FIG. 7. When the visualization unit 5 is brought closer to the connector 3 mounting the detection unit 4, the receiver 72 receives the signals sent by the transmitter 71 and the light-emitting circuit 14 thereby emits light.

Figure 8:
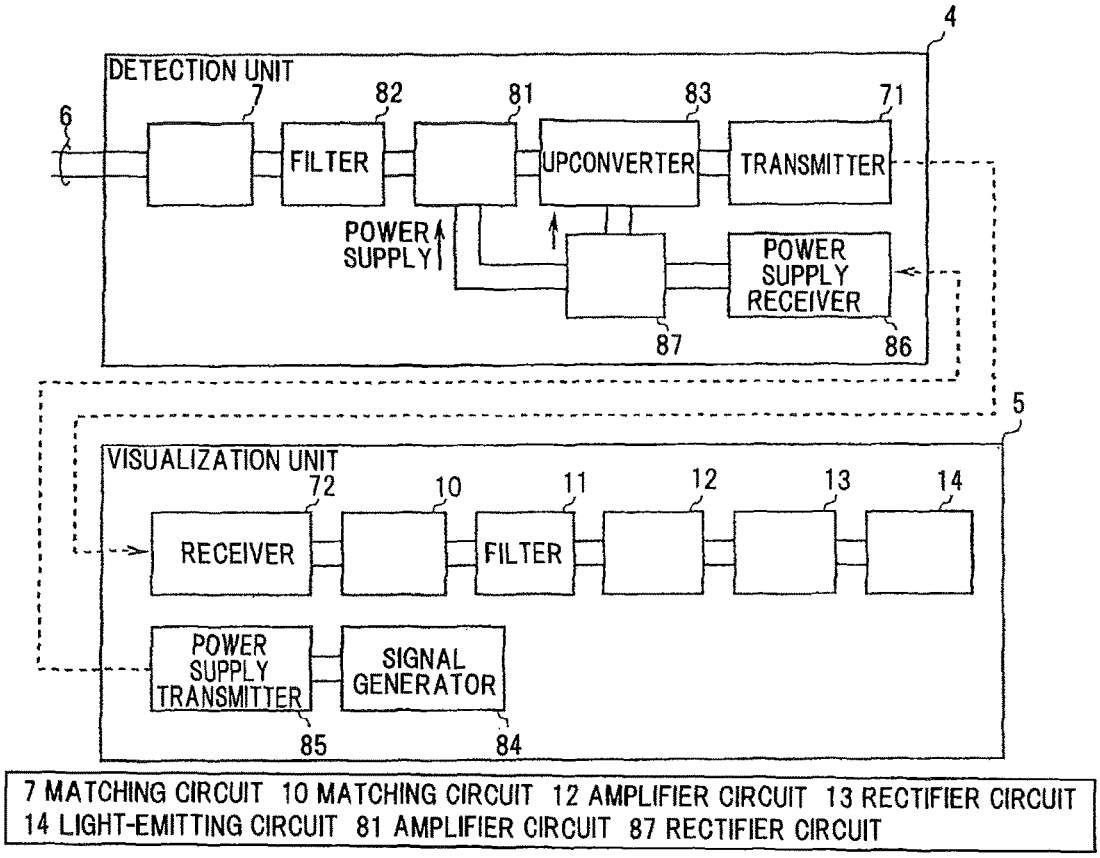
FIG. 8 is a diagrams illustrating a schematic configuration of a cable signal detector in another modification of the invention.

If the level of a signal input to the transmitter 71 is too small or the effect of noise is too large and causes communication failure, the detection unit 4 can be configured to include an amplifier circuit 81 which amplifies signals from the matching circuit 7 and outputs the amplified signals to the transmitter 71 as shown in FIG. 8 so that the signals amplified by the amplifier circuit 81 are sent from the transmitter 71.

In this case, a filter 82 for removing noise is provided anterior to the amplifier circuit 81, and an upconverter 83 for converting transmission frequency band is provided posterior to the amplifier circuit 81. The upconverter 83 can be omitted when it is not necessary to convert transmission frequency band.

When the amplifier circuit 81 is mounted on the detection unit 4 as shown in FIG. 8, a power supply for the amplifier circuit 81 (and the upconverter 83) is required. Thus, power is wirelessly transferred from the visualization unit 5 to the detection unit 4, thereby supplying power to the amplifier circuit 81 (and the upconverter 83).

In detail, a signal generator 84 for generating wireless power supply signals (with a continuous sine wave, at a high frequency with a substantially constant amplitude) and a power supply transmitter 85 such as antenna or coupler for sending the wireless power supply signals generated by the signal generator 84 are provided on the visualization unit 5. Also, a power supply receiver 86 such as antenna or coupler for supplying power to the amplifier circuit 81 (and the upconverter 83) based on reception of the wireless power supply signals is provided on the detection unit 4. Since the output of the power supply receiver 86 is AC, a rectifier circuit 87 is provided posterior to the power supply receiver 86 so that power supply signals rectified into DC are supplied to the amplifier circuit 81 or the upconverter 83.

In addition, although the connector 3 integrally provided on the communication cable 2 has been described in the present embodiment, it is not limited thereto. The connector 3 may be provided separately from the communication cable 2.

Figure 9:
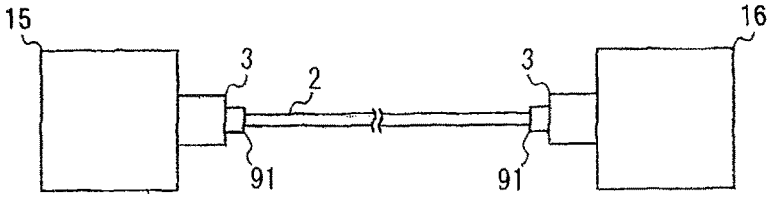
FIG. 9 is a diagrams illustrating a schematic configuration of a cable signal detector in still another modification of the invention.

For example, in the communication cable 2 having universal plugs (RJ45 plugs) 91 at both ends thereof, the connector 3 may be used to connect the plug 91 to the transmitter 15 or the receiver 16, as shown in FIG. 9. In this case, the connector 3 is provided with a receptacle for receiving the plug 91 to be inserted and a plug to be inserted into a receptacle of the transmitter 15 and the receiver 16.

In case that the connector 3 is a separate component, the communication cable 2 does not need to be changed when used in existing communication systems and can be introduced at lower cost.

As described above, in the cable signal detector 1 of the present embodiment, the detection unit 4 is provide in the connector 3 attached to an end of the communication cable 2 and branches, extracts and sends a portion of signal transmitted through the communication cable 2, and the visualization unit 5 is provided separately from the connector 3 and has the light-emitting circuit 14 which emits light when receiving the signals sent by the detection unit 4.

In such a configuration, since the light-emitting circuit 14 of the visualization unit 5 emits light during when signals are being transmitted through the communication cable 2, the communication state is indicated by presence/absence of light emission and it is thereby possible to prevent removal of the communication cable 2 by mistake.

In addition, in the present embodiment, it is possible to use a universal communication cable as the communication cable 2 and the cost is therefore low since it is not necessary to provide a monitoring signal line, etc., in the communication cable 2, unlike the conventional technique.

Next, another embodiment of the invention will be described.

Figure 10A:
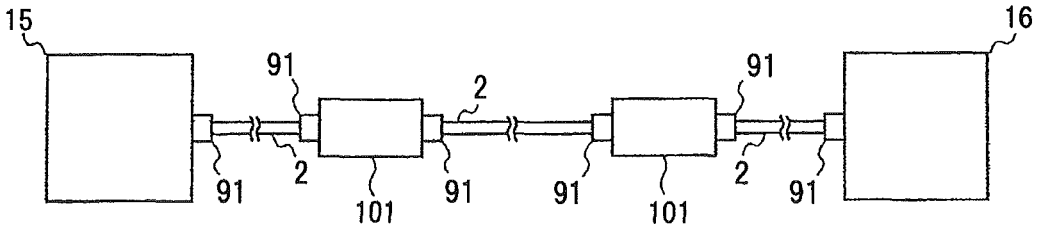
Figure 10B:
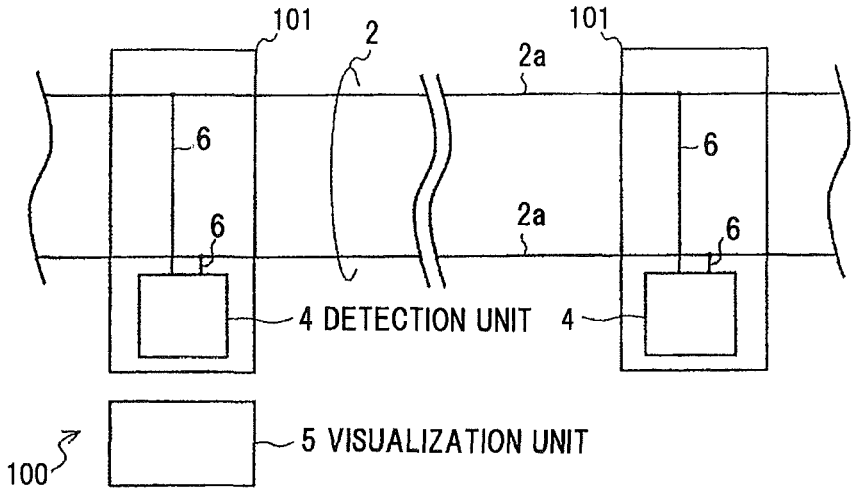

A cable signal detector 100 shown in FIGS. 10A and 10B is basically the same as the cable signal detector 1 of FIG. 1 but the detection unit 4 is provided in a relay connector 101 which is used for connection between two communication cables 2. In this case, the communication cable 2 integrally provided with the universal plugs 91 is used in the same manner as shown in FIG. 9.

Figure 11A:
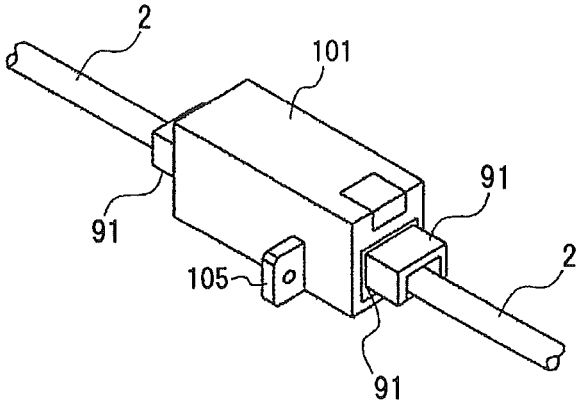
FIG. 11A is a perspective view showing a relay connector used for connection between connectors of the communication cables shown in FIGS. 10A and 10B.
Figure 11B:
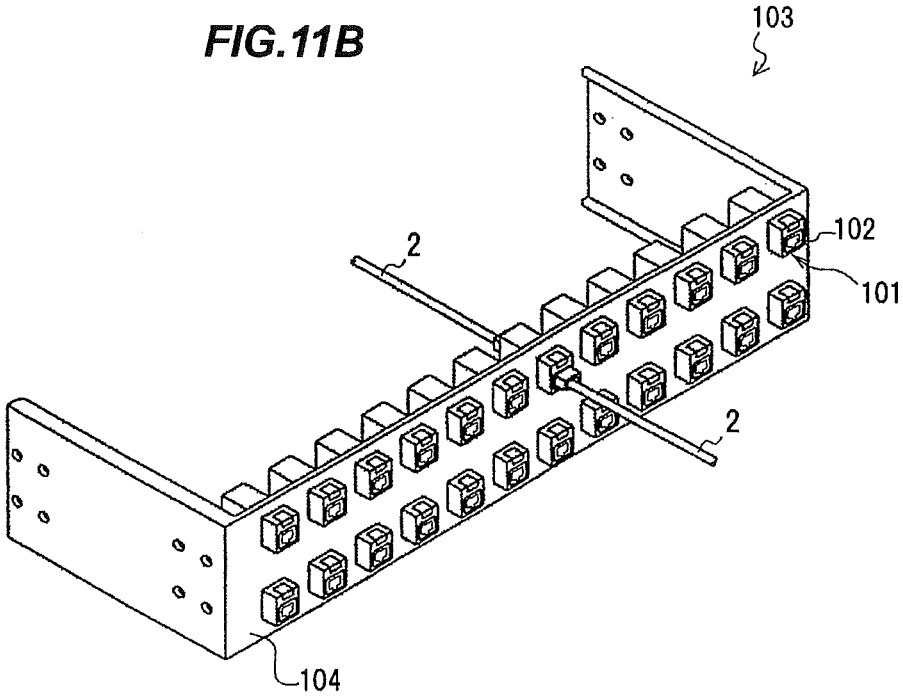
FIG. 11B is a perspective view showing a patch panel using the relay connectors.

As show in FIG. 11A, the relay connector 101 is provided with two receptacles 102 to be connected to the plugs 91 of the communication cables 2, and is also simply called "receptacle". As shown in FIG. 11B, plural relay connectors 101 each having a flange portion 105 for attachment to a panel 104 can be used to form a patch panel 103.

When providing the detection unit 4 in the relay connector 101, the communication cable 2 does not need to be changed when used in existing communication systems and can be introduced at lower cost.

The present invention is not intended to be limited to the embodiments, and it is obvious that the various kinds of changes can be made without departing from the gist of the invention.

For example, although the rectifier circuit 13 is provided anterior to the light-emitting circuit 14 in the present embodiment, it is not limited thereto. It is possible to omit the rectifier circuit 13 when a circuit with a transistor 121 as shown in FIG. 12 is used as the light-emitting circuit 14.

Figure 12:
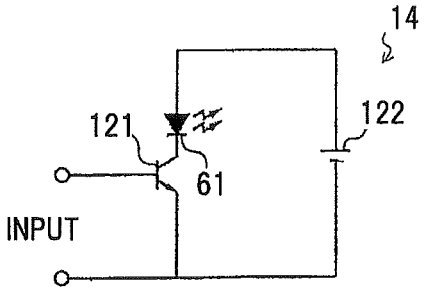
FIG. 12 is a circuit diagram illustrating a modification of the light-emitting circuit of the invention.

In the light-emitting circuit 14 shown in FIG. 12, signals from the amplifier circuit 12 are input to the base of the transistor 121, the LED 61 and a DC power supply 122 such as battery are inserted between an emitter and a collector of the transistor 121, and light is emitted from the LED 61 when switching the transistor 121.

What is claimed is:

1. A cable signal detector, comprising:

a detection unit configured to be provided in a connector attached to an end of a communication cable or in a relay connector to be connected to the connector, the connector or the relay connector comprising a signal line for transmitting a signal transmitted through the communication cable and a branch transmission path branched from the signal line for branching and transmitting a portion of the signal transmitted through the signal line, the detection unit being connected to the branch transmission path to detect and send the portion of the signal; and a visualization unit that is provided separately from the connector or the relay connector and comprises a light-emitting circuit to emit a light when receiving the signal sent from the detection unit.

2. The cable signal detector according to claim 1, wherein the detection unit comprises a detection unit-side electrode electrically connected to a signal line of the communication cable, wherein the visualization unit comprises a visualization unit-side electrode connected to the detection unit-side electrode, and wherein the visualization unit-side electrode is connected to the detection unit-side electrode such that the signal transmitted through the communication cable is received by the visualization unit.

3. The cable signal detector according to claim 2, wherein at least one of the detection unit and the visualization unit comprises a rectifier circuit for adjusting the level of the signal extracted from the communication cable.

4. The cable signal detector according to claim 2, wherein the detection unit-side electrode is provided inside connection holes formed in the connector, and the visualization unit-side electrode comprises a pin-shape and is inserted into the connection holes, such that the detection unit-side electrode is brought into contact with and electrically connected to the visualization unit-side electrode.

5. The cable signal detector according to claim 1, wherein the detection unit comprises a short-range communication transmitter electrically connected to a signal line of the communication cable, and wherein the visualization unit comprises a short-range communication receiver for receiving the signal sent from the transmitter.

6. The cable signal detector according to claim 5, wherein the detection unit comprises a rectifier circuit and an amplifier circuit between the signal line of the communication cable and the transmitter such that the signal amplified by the amplifier circuit is sent from the transmitter, wherein the rectifier circuit adjusts the level of the signal extracted from the cable and wherein the amplifier circuit amplifies the signal from the rectifier circuit and outputs the amplified signal to the transmitter.

7. The cable signal detector according to claim 6, wherein the detection unit comprises a power supply receiver to receive a wireless power supply signal to supply power to the amplifier circuit, and wherein the visualization unit comprises a power supply transmitter to send the wireless power supply signal to the power supply receiver.

8. The cable signal detector according to claim 1, further comprising:

a matching circuit provided on the branch transmission path, the matching circuit being formed in at least one of the detection unit and the visualization unit, and providing impedance matching in a predetermined frequency band.

9. The cable signal detector according to claim 8, wherein the matching circuit is formed in the detection unit and is mounted on a substrate provided inside the connector.

10. The cable signal detector according to claim 8, wherein the matching circuit is formed in the visualization unit and adjusts a level of a signal to be extracted from the communication cable.

11. The cable signal detector according to claim 8, wherein the matching circuit comprises one of a resistive voltage-divider circuit and a $\pi$-type matching circuit.

12. The cable signal detector according to claim 1, wherein the visualization unit comprises:

an amplifier circuit for amplifying the signal; and a band-pass filter which only passes frequencies within a predetermined range, to remove noise prior to amplification of the signal by the amplifier circuit.

13. A connectorized communication cable, comprising:

a communication cable;

a connector integrally formed at an end of the communication cable and comprising a signal line for transmitting a signal transmitted through the communication cable and a branch transmission path branched from the signal line for branching and transmitting a portion of the signal transmitted through the signal line;

a detection unit provided in the connector and connected to the branch transmission path to detect and send the portion of the signal transmitted through the cable; and a visualization unit that is provided separately from the connector and comprises a light-emitting circuit emitting light when receiving the signal sent from the detection unit.

14. The connectorized communication cable according to claim 13, wherein the detection unit comprises a detection unit-side electrode electrically connected to a signal line of the communication cable, wherein the visualization unit comprises a visualization unit-side electrode connected to the detection unit-side electrode, and wherein the visualization unit-side electrode is connected to the detection unit-side electrode such that the signal transmitted through the communication cable is received by the visualization unit.

15. The connectorized communication cable according to claim 14, wherein at least one of the detection unit and the visualization unit comprises a rectifier circuit for adjusting the level of the signal extracted from the communication cable.

16. The connectorized communication cable according to claim 13, wherein the detection unit comprises a short-range communication transmitter electrically connected to a signal line of the communication cable, and wherein the visualization unit comprises a short-range communication receiver for receiving the signal sent from the transmitter.

17. The connectorized communication cable according to claim 16, wherein the detection unit comprises a rectifier circuit and an amplifier circuit between the signal line of the communication cable and the transmitter such that the signal amplified by the amplifier circuit is sent from the transmitter, wherein the rectifier circuit adjusts the level of the signal extracted from the cable and wherein the amplifier circuit amplifies the signal from the rectifier circuit and outputs the amplified signal to the transmitter.

18. The connectorized communication cable according to claim 17, wherein the detection unit comprises a power supply receiver to receive a wireless power supply signal to supply power to the amplifier circuit, and wherein the visualization unit comprises a power supply transmitter to send the wireless power supply signal to the power supply receiver.

19. A cable signal detector, comprising:

a detection unit formed in a connector attached to an end of a communication cable, the connector comprising a signal line for transmitting a signal transmitted through the communication cable and a branch transmission path branched from the signal line for branching and transmitting a portion of the signal transmitted through the signal line, the detection unit being connected to the branch transmission path to detect and send the portion of the signal, and the detection unit comprising:

a detection unit-side electrode electrically connected to a signal line of the communication cable, for receiving the signal from the branch transmission path;

a rectifier circuit which adjusts a level of the signal extracted from the cable; and an amplifier circuit which amplifies the signal from the rectifier circuit and outputs the amplified signal; and a visualization unit that is provided separately from the connector and comprises a light-emitting circuit to emit a light when receiving the signal sent from the detection unit, the visualization unit comprising:

a visualization unit-side electrode connected to the detection unit-side electrode, for receiving the signal from the detection unit.

* * * * *